US005263466A

United States Patent [19]

Peck

[11] Patent Number: 5,263,466

[45] Date of Patent: Nov. 23, 1993

[54] BOW STRING RELEASE

[75] Inventor: Paul L. Peck, Fond du Lac, Wis.

[73] Assignee: Tru-Fire Corporation, N. Fond du Lac, Wis.

[21] Appl. No.: 805,877

[22] Filed: Dec. 9, 1991

Related U.S. Application Data

[63] Continuation of Ser. No. 535,892, Jun. 11, 1990, Pat. No. 5,078,116, which is a continuation-in-part of Ser. No. 518,957, May 4, 1990, Pat. No. 5,076,251.

[51] Int. Cl.[5] ..... F41B 5/18

[52] U.S. Cl. ..... 124/35.2

[58] Field of Search ..... 124/31, 35.1, 35.2

[56] References Cited

U.S. PATENT DOCUMENTS

| | | | |
|---|---|---|---|
| 1,542,159 | 6/1925 | Maxwell | 124/35.2 |
| 2,000,015 | 5/1935 | Flury | 124/35.2 |
| 2,819,707 | 1/1958 | Kayfes et al. | 124/35.2 |
| 4,036,204 | 7/1977 | Scott | 124/35.2 |
| 4,041,926 | 8/1977 | Troncoso, Jr. et al. | 124/35.2 |
| 4,151,825 | 5/1979 | Cook | 124/35.2 |
| 4,282,851 | 8/1981 | Lyons | 124/35.2 |
| 4,403,594 | 9/1983 | Todd | 124/35.2 |
| 4,476,845 | 10/1984 | Rickard | 124/35.2 |
| 4,527,536 | 7/1985 | Smith | 124/35.2 |
| 4,574,767 | 3/1986 | Gazzara | 124/35.2 |
| 5,020,508 | 6/1991 | Greene, Jr. | 124/35.2 |

*Primary Examiner*—Randolph A. Reese
*Assistant Examiner*—John Ricci
*Attorney, Agent, or Firm*—Robert C. Curfiss

[57] ABSTRACT

The bow string release includes a pair of sear elements which move in a substantially linear motion relative to one another between open and closed position in response to movement of a latch which pivots into and out of latching engagement with each of the sear elements.

5 Claims, 3 Drawing Sheets

FIG. 1
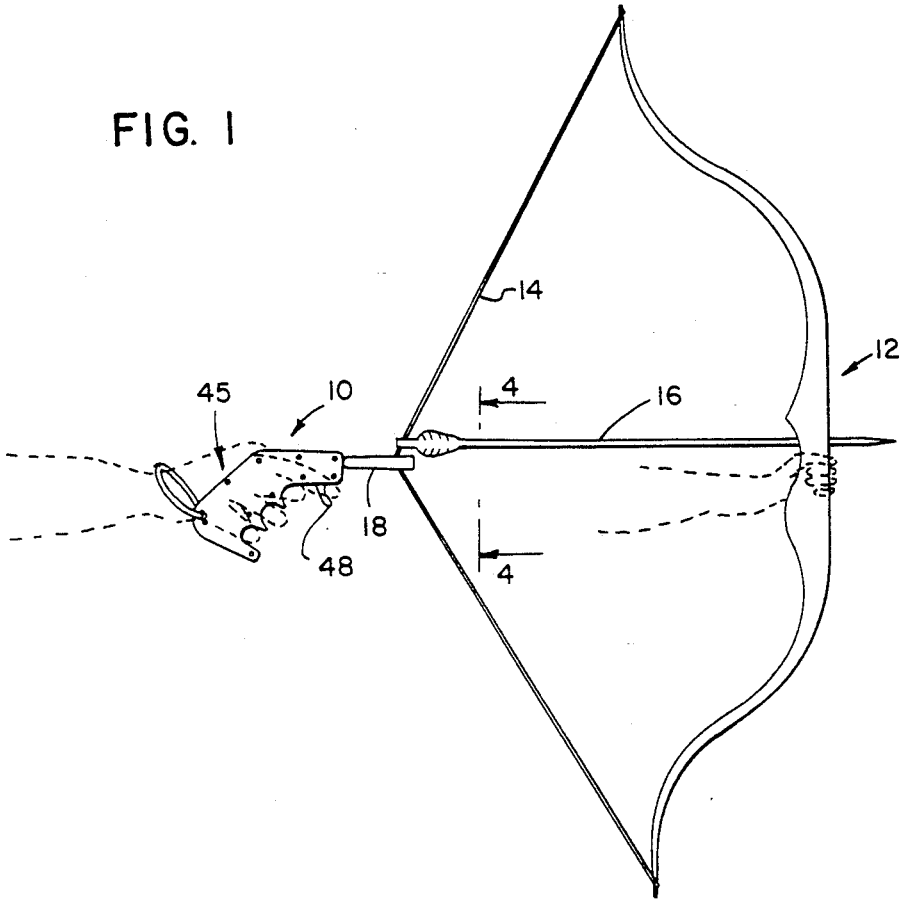
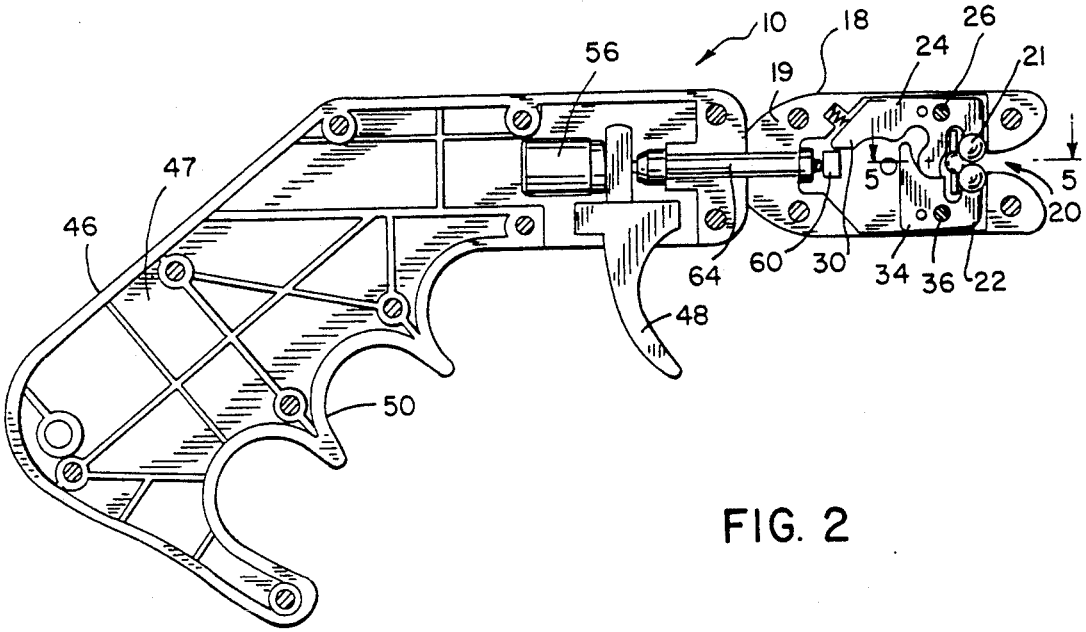
FIG. 2

BOW STRING RELEASE

This application is a continuation of application Ser. No. 07/535,892 filed Jun. 11, 1990, now U.S. Pat. No. 5,078,116, which is a continuation-in-part of application Ser. No. 07/518,957 filed May 4, 1990, now U.S. Pat. No. 5,076,251.

BACKGROUND OF THE INVENTION

This invention relates to bow string releases of the type having a releasable sear for retaining a bow string, the sear including a pair of elements adapted for movement into and out of a closed position to retain the bow string. A related application filed by the inventor named herein, on even date herewith; illustrates a variety of sear elements which may be used with the present invention.

Bow string releases have grown in popularity for target shooting and for hunting. A good release provides uniform release of the bow string and increases accuracy. The release is either hand-held or strapped to the wrist and has a trigger which permits the archer to release the string. Typically such devices employ a pivotal finger that engages the bow string, the finger being pivoted to a release position for releasing the string. Releases of this type are illustrated in U.S. Pat. Nos. 4,066,060; 3,898,974; and 3,954,095. It is known to use ball elements in place of the pivotal finger to retain and release the string, wherein the ball elements are held by a head and retained in position by a yoke or sleeve. A device of this type is illustrated in U.S. Pat. No. 4,403,594. While it is recognized that when the balls are separated by the tension of the string this provides minimal frictional engagement and a quiet release. Further, the balls do not produce a lateral bias on the string. However, this type of release has a significant disadvantage in that the amount of movement required to release the string is excessive when compared to the more common pivotal releases.

SUMMARY OF THE INVENTION

The bow string release of the present invention provides a synchronous, pivotable latch mechanism for releasing sear elements such as balls and the like. This design takes advantage of the superior features of ball type sear mechanisms while retaining the advantages of pivotable trigger releases. In particular, the latch mechanism of the present invention includes a synchronous mechanism wherein each of the sear elements are controlled by separate pivotable latch releases which move in synchronized motion upon activation of the trigger release. This permits the trigger to have a "feel" similar to that of other pivotable bow string releases while taking advantage of some of the superior features of linear motion sear elements.

The advantages and features of the invention will be more readily understood by reference to the drawings and detailed description which follow.

BRIEF DESCRIPTION OF THE DRAWINGS

FIG. 1 illustrates the bow string release of the present invention in typical use with a bow and arrow.

FIG. 2 is an enlarged view of the release of FIG. 1, with the head rotated 90° and the covers removed.

DETAILED DESCRIPTION OF THE INVENTION

Figure 3:
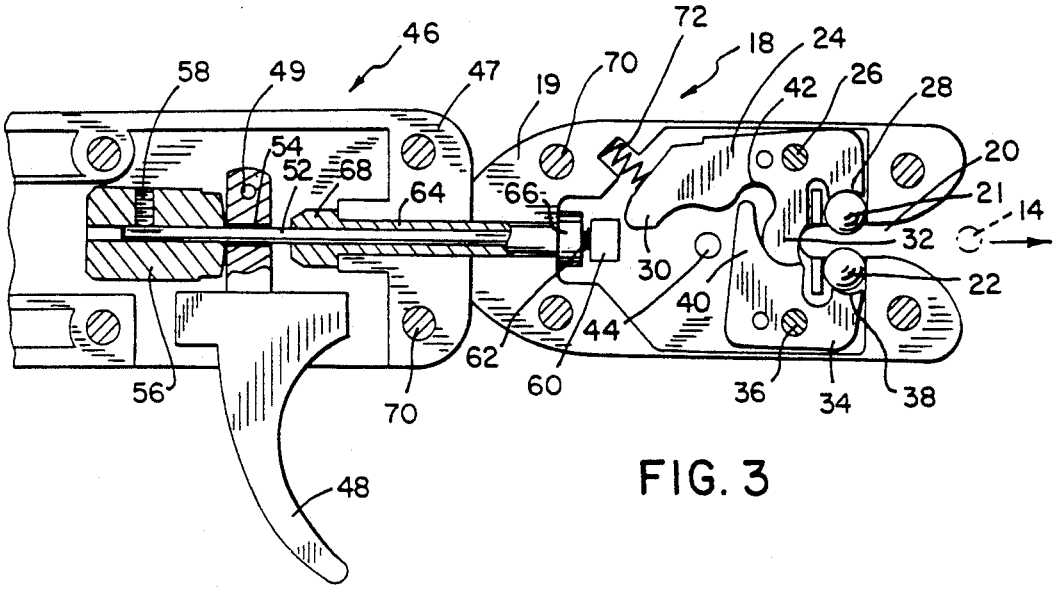
FIG. 3 is an enlarged fragmentary view of the release, looking in the same direction as FIG. 2.

As shown in FIG. 1, the bow string release 10 of the present invention includes a head 18 with the sear mechanism for retaining the bow string 14 of a typical bow 12 and a body 46 including a trigger 48 for releasing the string. When the trigger 48 is activated or pulled, the sear mechanism is opened to release the string 14 and fire the arrow 16. The novel features of the release are best shown in FIGS. 2 and 3, where the head 18 has been rotated 90° into alignment with the trigger grip 46 and the covers 29 and 57 have been removed to expose the working mechanism.

Figure 5:
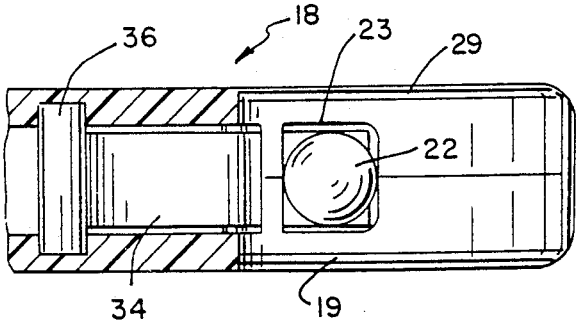
FIG. 5 is an enlarged fragmentary view taken at arrow 5 of FIG. 2.

The head 18 includes a base 19 with suitable recesses or channels 25 for carrying a pair of sear elements such as the balls 21 and 22 mounted in communication with the string retaining notch 20 of the head. The balls 21 and 22 are mounted in typical fashion for linear movement into and out of notch 20 and are shown in the extended, closed position in FIG. 2 and the retracted, open position in FIG. 3. As shown in FIG. 5, the base 19 and cover 29 of the head 18 form a window 23 through which the ball 22 extends. The window 23 is slightly smaller than the diameter of the ball, wherein the ball is retained in the head unless the cover 29 is removed from the base. Thus, the ball is free to move in a linear fashion in and out of the window 23 between the closed and open positions. While ball sear elements are described, it will be understood that any linear motion sear elements will work well with the design of the present invention, as will be described herein.

Each ball 21 and 22 is in communication with respective sear latch elements 24 and 34. The sear latch element 24 is pivotably mounted on post 26. The sear latch 34 is pivotably mounted on post 36. Each of latch elements 24 and 34 has a ball receptive seat 28 and 38 for receiving balls 21 and 22, respectively.

The extension tab 30 of the sear latch element 24 is in communication with the head 60 of the pin 62 of the trigger mechanism. The sear latch 24 is activated directly by the trigger release 48 and its movement controls the movement of the follower latch element 34. The finger 40 in the follower element 34 fits into the notch 42 provided in the controlling element 24. The self-locking tab 32 provided on the controlling element 24 engages the finger 40 and holds the follower element 34 in a closed position whenever the controlling element 24 is in the latched closed position as shown in FIG. 2.

The body 46 typically includes a base 47 with a trigger release 48 suitably pivotably mounted at the post 49. The base 47 and cover 57 (FIG. 4) typically define a handle grip 50 by which the release is held. A latch release mechanism such as the pin 52 is in engagement with and moves with the trigger release 48, as illustrated by the through hole 54 through which the pin passes to be received in retainer 56 and secured therein by set screw 58. The pin 52 may be adjustably retained in the retainer 56 to adjust the amount of trigger pull required to activate the sear.

Figure 4:
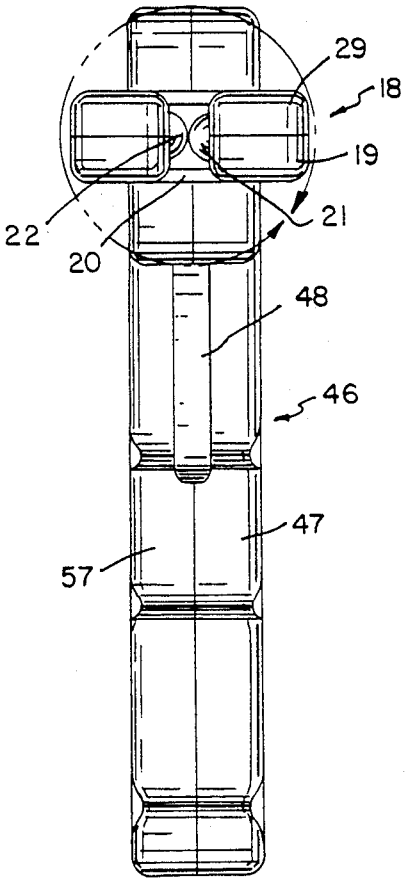
FIG. 4 is a view taken at arrow 4 in FIG. 1.

In the illustrated embodiment, the head 18 and grip 46 are mounted for rotation on a hollow cylindrical shaft 64 having enlarged ends 66 and 68. When the covers 29 and 57 are placed on the head base 19 and the grip base 47, respectively, and held in place by means such as the screws 70 or the like, the head and grip are held in secure assembly on shaft 64 and may be rotated 360° relative to one another as shown in FIG. 4.

The pin 52 extends through the hollow shaft 64 and includes an enlarged head 60 suited for engagement with the latch extension tab 30 of the controlling latch 24. A compression spring 62 is mounted between the end 66 of the shaft and the pin head 60 to urge the pin toward and into engagement with the latch extension tab 30. When the trigger release 48 is pulled toward the grip 50, the pin retainer 56 is moved back, pulling the pin 52 head 60 away from the latch extension tab 30. The force of the bow string 14 pushes the balls 21 and 22 into the open retracted position and the string is released (FIG. 3).

A compression spring 72 is seated in a suitable recess in the head and urges the latch element 24 into the opened, retracted position once the string is released. When the string is reinserted in the notch 20, it engages the self-locking ear 32 of the controlling latch element 24 and overcomes the force of spring 72 to urge the latch element 24 back into the closed position (FIG. 2). The extension tab 30 pivots up over the pin head 60 and the spring 62 urges the pin into latching engagement with the latch element. Self-locking gear 32 engages the follower finger 40 of the latch element 34 and likewise urges it and the ball 22 into the closed position. The string is now reloaded and ready to fire. The post 44 can provide a positive stop for limiting the forward movement of the latch element 29 when it is unlatched. The tab 30 will pivot toward and be stopped by post 44, assuring that the assembly does not move beyond acceptable limits when the string is released.

Figure 6:
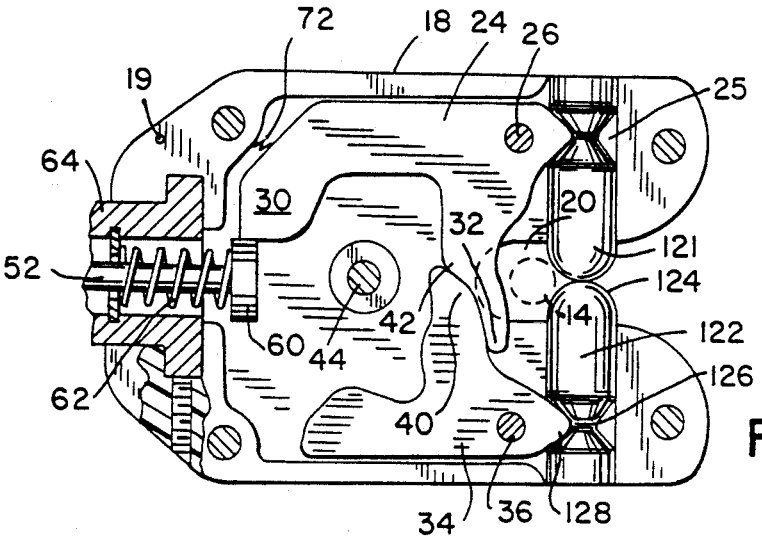
FIG. 6 is a fragmentary view of the head of the release, including modified, linear travel sear elements.

Modified linear motion sear elements 121 and 122 are shown in FIG. 6. Each sear is an elongate cylinder with a spherical end portion 124 conforming to the shape of the balls 21, 22. A tapered channel 126 is provided near the opposite end of the sear and is adapted to receive finger 128 provided on each latch element 24, 34. When the pin 52 is retracted to release the latch elements, the string 14 is released as the sears retract from the notch. The fingers 128 remain in channels 126 and when the string is reinserted, it engages tab 32, urging the latch elements back into the latched position and closing sears 121 and 122. The spring 72 normally biases the sears into the open position when the latch elements are released.

Figure 7:
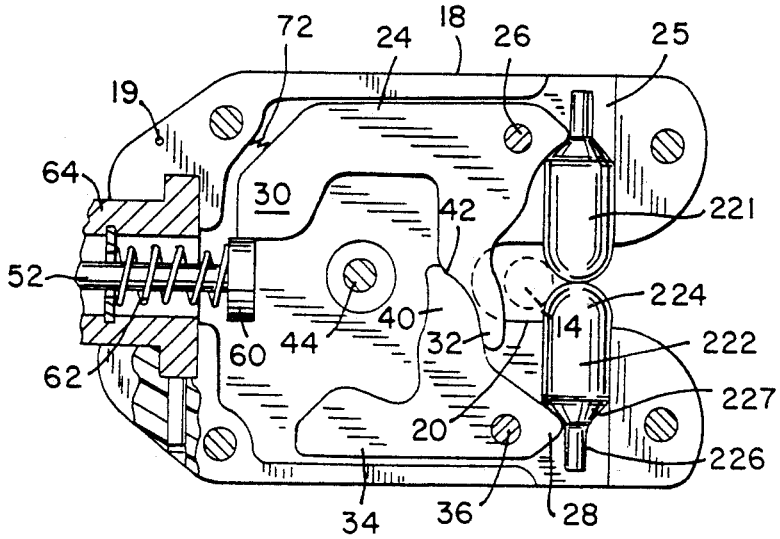
FIG. 7 is a fragmentary view of the head of the release, similar to FIG. 7 but showing another embodiment of linear travel sear elements.

An alternative to the sear configuration of FIG. 6 is illustrated in FIG. 7. The sear elements 221 and 222 are each again an elongate cylinder with a spherical head 224. The opposite end is tapered at 227 into a reduced end portion 226 which is adapted for engaging the fingers 128 of the latch elements 24 and 34. The fingers 128 maintain the sears in the closed position when the latch is closed. Upon opening, the fingers pivot away from the notch 20 and permit axial movement of the sears 221, 222 out of the notch to release the string 14. Tab 32 intercepts the string when it is reinserted, closing the latch and the sears.

Figure 8:
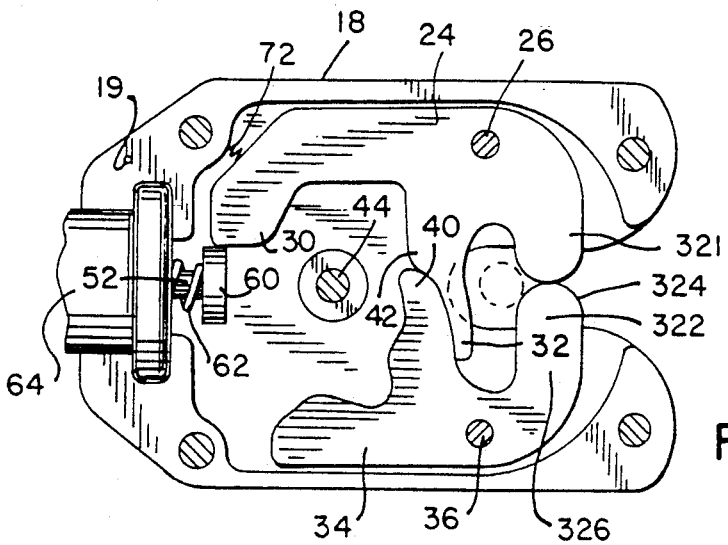
FIG. 8 is a fragmentary view of the head of the release, including modified sear elements integral with a pivotable latch release

An additional modification is illustrated in FIG. 8. As there shown, the sear elements 321 and 322 are an integral part of the latch elements 24 and 34, respectively. Each sear has a radius 324 at its outer end, conforming generally to the circumference of the ball sears 21 and 22. Each sear comprises a leg 226 extending at a generally right angle from the respective latch element. When the latch is released, and latch elements 24 and 34 pivot to the open position, sears 321 and 324 retract from the string notch 20 to release string 14. The radial end provides a simulated linear action much like known ball sear elements. When the string is reinserted, it engages tab 32, closing the latch elements and the respective sears. Spring 72 normally biases the latch elements and sears into the open position.

While specific features and embodiments of the invention have been shown and described herein, it will be readily understood that the invention encompasses all modifications and alternatives within the scope and spirit of the following claims.

What is claimed is:

1. A bow string release of the type having a head with a pair of sear elements mounted therein for movement between a latched, closed, string retaining position, and an unlatched, open string releasing position, a releasable latch mechanism is communication with at least one of the sear elements and movable between a first, engaged position for maintaining the sear elements in the latched, closed string retaining position, and a second, unlatched position for releasing the sear elements to the unlatched, open string releasing position, the sear elements further comprising:

a. a first elongated jaw member having a longitudinal axis and pivotally mounted at a first position in the head and having one end adjacent to and in communication with the latch mechanism and an opposite, outer end including a first sear defining tip;

b. a second elongated jaw member having a longitudinal axis and pivotally mounted at a second position in the head and having one end adjacent to but not in communication with the latch mechanism and an opposite, outer end including a second sear defining tip, wherein the first sear defining tip and the second sear defining tip are disposed in abutting contact with one another when the sear elements are in the string retaining position and are separated form one another when the sear elements are in the open, string releasing position; and c. each of the sear defining tips comprising an integral part of a respective jaw and extends generally perpendicular from the longitudinal axis of the respective jaw toward the other of said jaws to define a substantially L-shaped outer end, wherein each of said sear defining tips includes a generally spherically shaped outer end, the outer ends adapted to abut one another and form a substantially V-shaped channel for retaining the string when the sears are in the closed, string retaining position.

2. The bow string release of claim 1 wherein the outer ends of the sear defining tips pivot outwardly from one another.

3. The bow string release of claim 1, wherein said latch mechanism is in direct communication with only one of jaws.

4. The bow string release of claim 1, wherein said latch mechanism is connected to one of said jaws and there is further included means mounted on the other of said jaws adapted for translating the movement of said one jaw to said other jaw when said one jaw is moved in response to movement of said latch mechanism.

5. The bow string release of claim 1, wherein said latch mechanism includes a finger actuated trigger.

* * * * *